US005415104A

United States Patent [19]

Bispling et al.

[11] Patent Number: 5,415,104

[45] Date of Patent: May 16, 1995

[54] PRACTICE AMMUNITION

[75] Inventors: Bernhard Bispling, Ratingen; Wilheim Scheland, Unteruss, both of Germany

[73] Assignee: Reinmetall GmbH, Ratingen, Germany

[21] Appl. No.: 282,435

[22] Filed: Jul. 29, 1994

[30] Foreign Application Priority Data

Jul. 29, 1993 [DE] Germany ..... 43 25 428.4

[51] Int. Cl.[6] ..... F42B 8/04

[52] U.S. Cl. ..... 102/444; 102/439; 102/498; 102/529; 102/530

[58] Field of Search ..... 102/395, 430, 439, 444, 102/446, 447, 498, 530, 531, 529

[56] References Cited

U.S. PATENT DOCUMENTS

| | | | |
|---|---|---|---|
| 3,048,104 | 8/1962 | Riggs | 102/530 |
| 5,016,536 | 5/1991 | Brighton . | |
| 5,259,319 | 11/1993 | Dravecky et al. . | |

FOREIGN PATENT DOCUMENTS

| | | | |
|---|---|---|---|
| 1448834 | 7/1966 | France | 102/444 |
| 1453832 | 5/1969 | Germany | 102/530 |
| 4128050 | 2/1993 | Germany | 102/444 |
| 14208 of 1905 | | United Kingdom | 102/530 |

*Primary Examiner*—Harold J. Tudor
*Attorney, Agent, or Firm*—Spencer, Frank & Schneider

[57] ABSTRACT

A practice ammunition includes a propellant case having a case body; a circumferential mouth part; and a circumferential shoulder connecting the case body with the mouth part. The shoulder tapers from the case body toward the mouth part. The practice ammunition further includes a bursting body having a rear part fitted into the mouth part. The rear part is provided with a circumferential groove including a relatively deep frontal groove zone and an adjoining, relatively shallow rear groove zone, whereby the groove is stepped as viewed in the direction of the longitudinal axis of the ammunition. There is further provided a holding ring so dimensioned that it is compressible such as to be fully receivable within the deep groove zone. The holding ring surrounds the rear part of the bursting body and is clamped between the rear groove zone and the inner surface of the shoulder, whereby the holding ring assumes a wedged state. In such a wedged state the holding ring has an outer diameter which is greater than the outer diameter of the rear part measured at a location axially rearwardly of the groove and is greater than the inner diameter of the mouth part.

6 Claims, 1 Drawing Sheet

PRACTICE AMMUNITION

BACKGROUND OF THE INVENTION

This invention relates to a practice ammunition including a propellant case which has a mouth part and an inclined shoulder and further has a bursting body whose rearward portion is fitted into the mouth part and secured thereto.

German Offenlegungsschrift 41 28 050 discloses a practice ammunition whose bursting body emulates a shell and has, at both ends, a collar portion of increased diameter. The rearward collar of the bursting body is received by the mouth part of the case and is glued or crimped thereto. The frontal collar which is provided with a chamfer, serves to engage an oblique run-on surface provided in the inside of an adapter sleeve inserted in the weapon barrel during field exercises. Such an engagement which takes place as the practice ammunition is loaded into the barrel, causes the bursting body to be pushed into the propellant case during loading of the ammunition into the barrel. After firing, the propellant case is ejected, together with the major part of the bursting body disposed therein. If, however, against regulations, the practice ammunition is fired from a weapon without using the practice insert (adapter) in the barrel, the bursting body may leave the propellant case, posing a substantial danger to personnel.

SUMMARY OF THE INVENTION

It is an object of the invention to provide an improved practice ammunition of the above-outlined type which does not pose a safety risk even if fired from a non-modified weapon normally firing live ammunition.

This object and others to become apparent as the specification progresses, are accomplished by the invention, according to which, briefly stated, the practice ammunition includes a propellant case having a case body; a circumferential mouth part; and a circumferential shoulder connecting the case body with the mouth part. The shoulder tapers from the case body toward the mouth part. The practice ammunition further includes a bursting body having a rear part fitted into the mouth part. The rear part is provided with a circumferential groove including a relatively deep frontal groove zone and an adjoining, relatively shallow rear groove zone, whereby the groove is stepped as viewed in the direction of the longitudinal axis of the ammunition. There is further provided a holding ring so dimensioned that it is compressible such as to be fully receivable within the deep groove zone. The holding ring surrounds the rear part of the bursting body and is clamped between the rear groove zone and the inner surface of the shoulder, whereby the holding ring assumes a wedged state. In such a wedged state the holding ring has an outer diameter which is greater than the outer diameter of the rear part measured at a location axially rearwardly of the groove and is greater than the inner diameter of the mouth part.

DESCRIPTION OF THE PREFERRED EMBODIMENT

Figure 4:
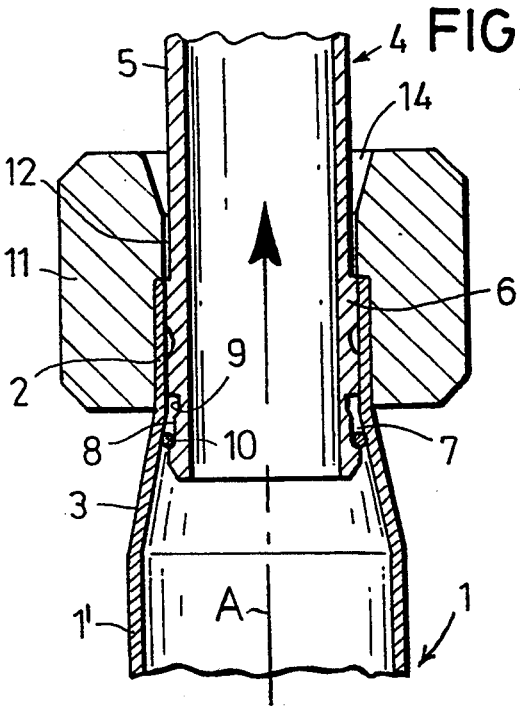

Turning first to FIG. 4, the practice ammunition according to the invention, shown in a finally assembled state, comprises a propellant case 1 having a case body 1', a mouth portion 2 having an inner diameter d (shown in FIG. 1) and an inclined circumferential shoulder 3 connecting the case body 1' with the mouth portion 2 and tapering theretoward. The shoulder 3 arrives in a face-to-face engagement with a correspondingly shaped shoulder of an ammunition support in a weapon barrel or tube. The ammunition, thus essentially composed of the propellant case 1 and the bursting body 4, has a longitudinal axis A.

The propellant case 1 receives a bursting body 4 which is in the shape of a live ammunition and includes a cylindrical portion 5 which is provided at both ends with a circumferential enlargement (collar) having an outer diameter greater than the outer diameter of the cylindrical part 5. The rear collar 6 (the front collar is not shown) is received by the mouth part 2 of the propellant case 1 and is connected therewith by gluing or crimping. The rear collar 6 has a circumferential groove 7 which is stepped in the axial direction. The rearward zone 8 of the groove 7 has a greater diameter (and is thus "shallower") than the frontal groove zone 9. The groove 7 accommodates a split holding ring 10 made, for example, of cross-sectionally circular spring steel whose inner diameter has, in a non-compressed state, a clearance with respect to the diameter of the rearward zone 8 of the groove 7 and whose outer diameter is, even in a compressed state, greater than the outer diameter of the rearward collar 6. The diameter and length of the frontal zone 9 of the groove 7 is so dimensioned that it is adapted to fully receive therein the holding ring 10 compressed to the outer diameter of the rearward collar 6. Expediently, the holding ring 10 is approximately twice as thick as the depth of the rearward zone 8 of the groove 7, wherein such depth equals the difference between the diameter of the rearward collar 6 and the diameter of the rearward zone 8.

By virtue of the above arrangement, when the bursting body 4 is in its final inserted position in the mouth part 2 of the propellant case 1 as shown in FIG. 4, the holding ring 10 is seated on the rearward zone 8 of the groove 7 and is also in engagement with the inner side of the oblique shoulder 3 of the propellant case 1. Consequently, in such a wedged state, the outer diameter of the holding ring 10 is greater than the inner diameter d of the mouth part 2. Thus, the holding ring is wedged between the propellant case 1 and the bursting body 4, so that the holding ring 10, even upon firing of the practice ammunition from a normal weapon without a practice adapter, holds the bursting body 4 in the propellant case and consequently, the bursting body 4 cannot leave the weapon tube and pose a substantial safety risk.

The groove zone 8 has an axial length which corresponds to at least twice the diameter of the ring cross section (ring thickness) so that the holding ring 10, when the cartridge is exposed to stress forces involving transport or rough handling, cannot be displaced into the frontal zone 9 of the groove 7 if, in response to such forces, a slight shift of the bursting body 4 into the propellant case 1 occurs.

To instal the bursting body 4 in the propellant case 1 a tool 11 is used which has a throughgoing bore 12 having a first length portion in which the mouth part 2 of the propellant case 1 is inserted and a second length portion through which the rear portion of the bursting body 4 is passed. The first length portion has an inner diameter generally equalling the outer diameter of the mouth part 2, while the second length portion has an inner diameter generally equalling the diameter of the collar 6 (which is substantially the same as the inner diameter d of the mouth part 2). The two length portions are separated by a step or shoulder 13 against which the mouth part 2 of the propellant case 1 abuts as it is introduced into the tool 11. The second length portion has an outwardly flaring, funnel-shaped entrance enlargement 14 for receiving the bursting body 4.

Figure 1:
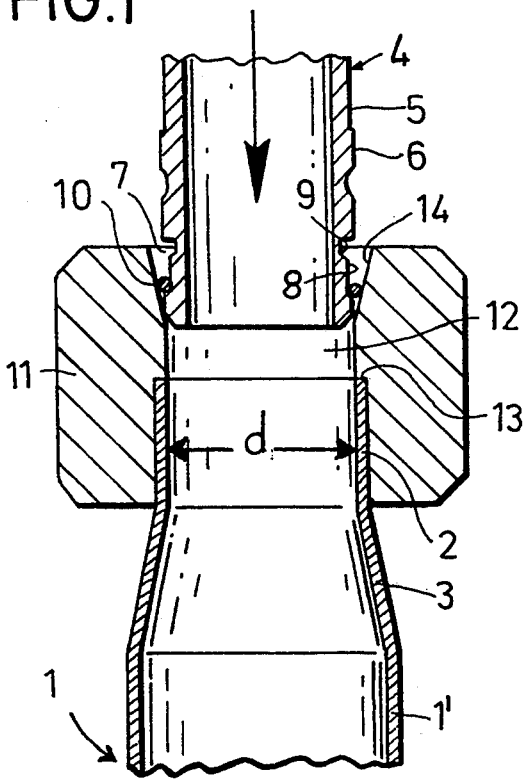
FIGS. 1–4 are axial sectional views of consecutive steps of assembling a bursting body with a propellant case to obtain a preferred embodiment of the invention.
Figure 2:
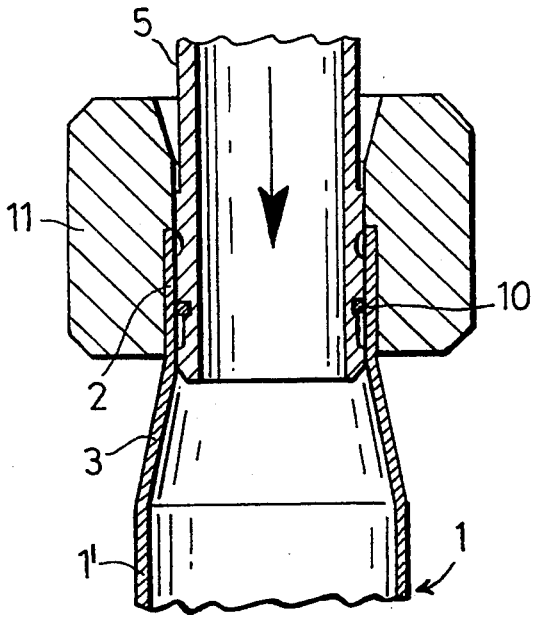
Figure 3:
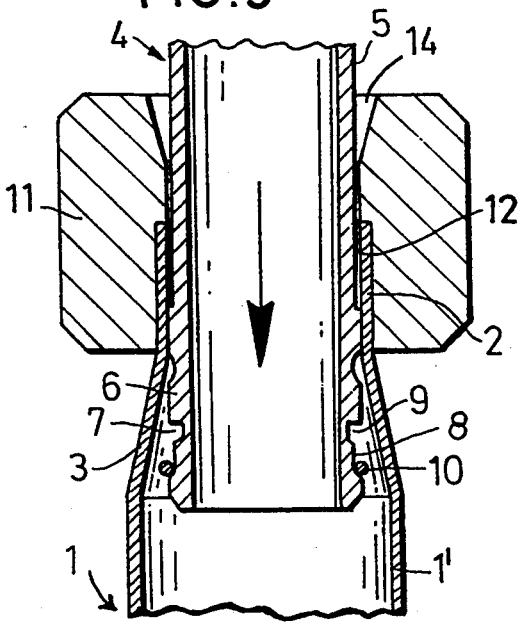

As shown in FIG. 1, the bursting body 4 is, together with the holding ring 10 situated in the region of the groove 7 pushed into the bore 12 through the entrance enlargement 14. During this step, the holding ring 10 is first pushed into the deeper zone 9 of the groove 7 and subsequently, while compressed to the outer diameter of the collar 6, the holding ring 10 is received by the deeper zone 9 of the groove 7 (FIG. 2) so that the holding ring 10 may, together with the collar 6 of the bursting body 4, be pushed through the mouth portion 2 of the propellant case 1 (FIG. 3). After the holding ring 10 has passed the mouth portion 2 and is situated in the zone of the inclined shoulder 3, it again expands and falls from the deeper zone 9 of the groove 7 onto the shallower (large-diameter) zone 8 of the groove 7.

Thereafter, the bursting body 4 is pulled upwardly (FIG. 4), whereby the holding ring 10 is clamped between the rearward zone 8 of the groove 7 and the shoulder 3 of the propellant case 1.

In this manner a simple, inexpensive assembly of the practice ammunition may be effected.

It will be understood that the above description of the present invention is susceptible to various modifications, changes and adaptations, and the same are intended to be comprehended within the meaning and range of equivalents of the appended claims.

What is claimed is:

1. A practice ammunition having a longitudinal axis and comprising (a) a propellant case including (1) a case body;

(2) a circumferential mouth part having an inner diameter; and (3) a circumferential shoulder connecting said case body with said mouth part; the shoulder having an inner surface and tapering from said case body toward said mouth part;

(b) a bursting body having a rear part fitted into said mouth part; said rear part being provided with a circumferential groove including a frontal groove zone and an adjoining rear groove zone; said frontal groove zone being deeper than said rear groove zone, whereby said groove is stepped as viewed in the axial direction; said frontal groove zone and said rear groove zone each having a diameter and an axial length; and (c) a holding ring being so dimensioned that it is compressible such as to be fully receivable within said deep groove zone; said holding ring surrounding said rear part of said bursting body and being clamped between said rear groove zone and said inner surface of said shoulder, whereby said holding ring assumes a wedged state; in said wedged state said holding ring having an outer diameter greater than an outer diameter of said rear part measured at a location axially rearwardly of said groove and greater than said inner diameter of said mouth part.

2. The practice ammunition as defined in 1, wherein said holding ring is approximately twice as thick as a depth of said rear groove zone.

3. The practice ammunition as defined in 1, wherein said holding ring is a split spring ring having a circular cross-sectional outline.

4. The practice ammunition as defined in 3, wherein said rear groove zone has an axial length at least twice the cross-sectional diameter of said holding ring.

5. The practice ammunition as defined in 1, wherein said bursting body includes a body portion having an outer diameter; and further wherein said rear part of said bursting body includes a collar having an outer diameter greater than the outer diameter of said body portion; said groove being provided in said collar.

6. The practice ammunition as defined in 1, wherein in a non-compressed state said holding ring has an inner diameter greater than said diameter of said rear groove zone.

* * * * *

UNITED STATES PATENT AND TRADEMARK OFFICE

CERTIFICATE OF CORRECTION

PATENT NO. : 5,415,104

DATED : May 16, 1995

INVENTOR(S) : Bernhard Bisping et al

It is certified that error appears in the above-indentified patent and that said Letters Patent is hereby corrected as shown below:

On the title page, item [75], the first inventor's name should read --Bernhard Bisping--; the second inventor's name should read --Wilhelm Scheland--; and the second inventor's city of residence should read --Unterlüss--.

On the title page, item [73], the assignee's name should read --Rheinmetall GmbH--.

Signed and Sealed this

Eighteenth Day of July, 1995

Bruce Lehman

*Attest:*

BRUCE LEHMAN

*Attesting Officer*

*Commissioner of Patents and Trademarks*